United States Patent [19]

Althouse et al.

[11] Patent Number: 4,889,502

[45] Date of Patent: Dec. 26, 1989

[54] CONNECTOR HAVING DROP-IN INSERT CONDUCTIVE WITH SHELL

[76] Inventors: Rickie M. Althouse, 2000 Haddam Neck Ct., Harrisburg, Pa. 17110; Richard I. Baer, 1030 Laurel Dr., Middletown, Pa. 17057; Ronald L. Brandt, R.D. #2, Box 41D, Palmyra, Pa. 17078

[21] Appl. No.: 245,836

[22] Filed: Sep. 16, 1988

Related U.S. Application Data

[63] Continuation-in-part of Ser. No. 79,204, Jul. 29, 1987, abandoned.

[51] Int. Cl.[4] ..... H01R 13/658

[52] U.S. Cl. ..... 439/607; 439/83

[58] Field of Search ..... 439/95, 108, 607–610, 439/876, 83

[56] References Cited

U.S. PATENT DOCUMENTS

| | | | |
|---|---|---|---|
| 4,435,031 | 3/1984 | Black et al. | 339/17 |
| 4,461,537 | 7/1984 | Raymer et al. | 350/96 |
| 4,477,142 | 10/1984 | Cooper et al. | 339/125 |
| 4,512,618 | 4/1985 | Kumar | 339/14 |
| 4,570,338 | 2/1986 | Ignatowicz | 439/876 |
| 4,609,242 | 9/1986 | Kemppainen | 339/17 |
| 4,639,066 | 1/1987 | Shimamiya et al. | 339/132 |
| 4,679,883 | 7/1987 | Assini et al. | 439/607 |
| 4,693,532 | 9/1987 | Colleran et al. | 439/594 |
| 4,709,973 | 12/1987 | Waters et al. | 439/78 |
| 4,717,219 | 1/1988 | Frantz et al. | 439/82 |
| 4,721,473 | 1/1988 | Delguidice et al. | 439/79 |

FOREIGN PATENT DOCUMENTS 0180284 10/1985 European Pat. Off. .

OTHER PUBLICATIONS

Amplimite Subminatured Connectors for Robotic, Surface-Mount APP, Issued 8-87.

AMP Incorporated Drawing Sheet 747621.

Holmberg Product Line Catalog.

*Primary Examiner*—Gary F. Paumen

*Attorney, Agent, or Firm*—David L. Smith

[57] ABSTRACT

An electrical connector assembly (10) has a drawn solderable insert (42) received in a mounting aperture (28) of an electrical connector housing (12) and secured therein by a shell (30). The insert (42) has an internally threaded (52) hollow tubular shank (44). Flange means (46) on the insert (42) are received in a recess (54) in either a shell means or the housing (12) and cooperates therewith to prevent the insert (42) from rotating. The flange means (46) are thicker than the depth of the recess (54) to assure electrical continuity between the insert (42) and the shell (30). In a first embodiment, the shank (44) extends beyond the connector housing (12) to a closed end (50) that may be tapered. An alternate embodiment insert (42') has an open end. Yet another alternate embodiment insert (42'') has spring means (74,76) that cooperate with insert receiving aperture (60) to secure connector assembly (10) to printed circuit board (62). A further alternate embodiment insert has a spacer means (102) thereon.

25 Claims, 5 Drawing Sheets

CONNECTOR HAVING DROP-IN INSERT CONDUCTIVE WITH SHELL

This application is a continuation-in-part application of application Ser. No. 079,204 filed July 29, 1987, now abandoned.

BACKGROUND OF INVENTION

This invention relates to an electrical connector assembly having an insert for securing an electrical connector to a printed circuit board, and in particular to an electrical connector assembly including an insert having a hollow internally threaded shank surrounded by a flange that prevents rotation of the insert.

Prior art inserts for securing electrical connector assemblies to each other or to a printed circuit board were typically machined parts, such as would be manufactured on a screw machine, that were knurled on an exterior surface. Such machined parts are relatively expensive to manufacture. The prior art inserts were typically heat staked or ultrasonically welded into a connector flange aperture. Alternatively, inserts were manufactured with barbs thereon and were pressed into a connector flange, as taught by U.S. Pat. No. 4,709,973. The present invention provides an electrical connector assembly having a solderable insert that is relatively lower in cost to manufacture.

SUMMARY OF THE INVENTION

In accordance with the present invention, an electrical connector assembly has a dielectric housing having terminal receiving passages extending between a mating face and a rear face, with terminals secured therein. The electrical connector assembly has at least one electrically conductive shell member which provides shielding and a common ground to a complementary mated connector. Lugs secure the shell to either the dielectric housing or another shell member. The insert extends into an aperture in a housing flange or a flange of the second shell member and is secured therein by a shell member. The insert has flange means received in a recess in the housing or a flange of the second shell member which cooperate to prevent rotation of the insert. The thickness of the flange means is greater than the depth of the recess to assure electrical engagement between the insert and at least one shell member. The hollow tubular shank of the insert is internally threaded to receive a complementary threaded securing means through an aligned aperture in the shell. The shank of the insert may extend beyond the connector housing tapering to a closed end to prevent solder from wicking into the threads or may have a pair of spring means extending from the closed end. The spring means have a converging and a diverging section which cooperate with an insert receiving aperture in a printed circuit board to secure a connector assembly to the printed circuit board. Alternatively, a spacer means may extend from the flange means.

DESCRIPTION OF THE PREFERRED EMBODIMENT

Figure 1:
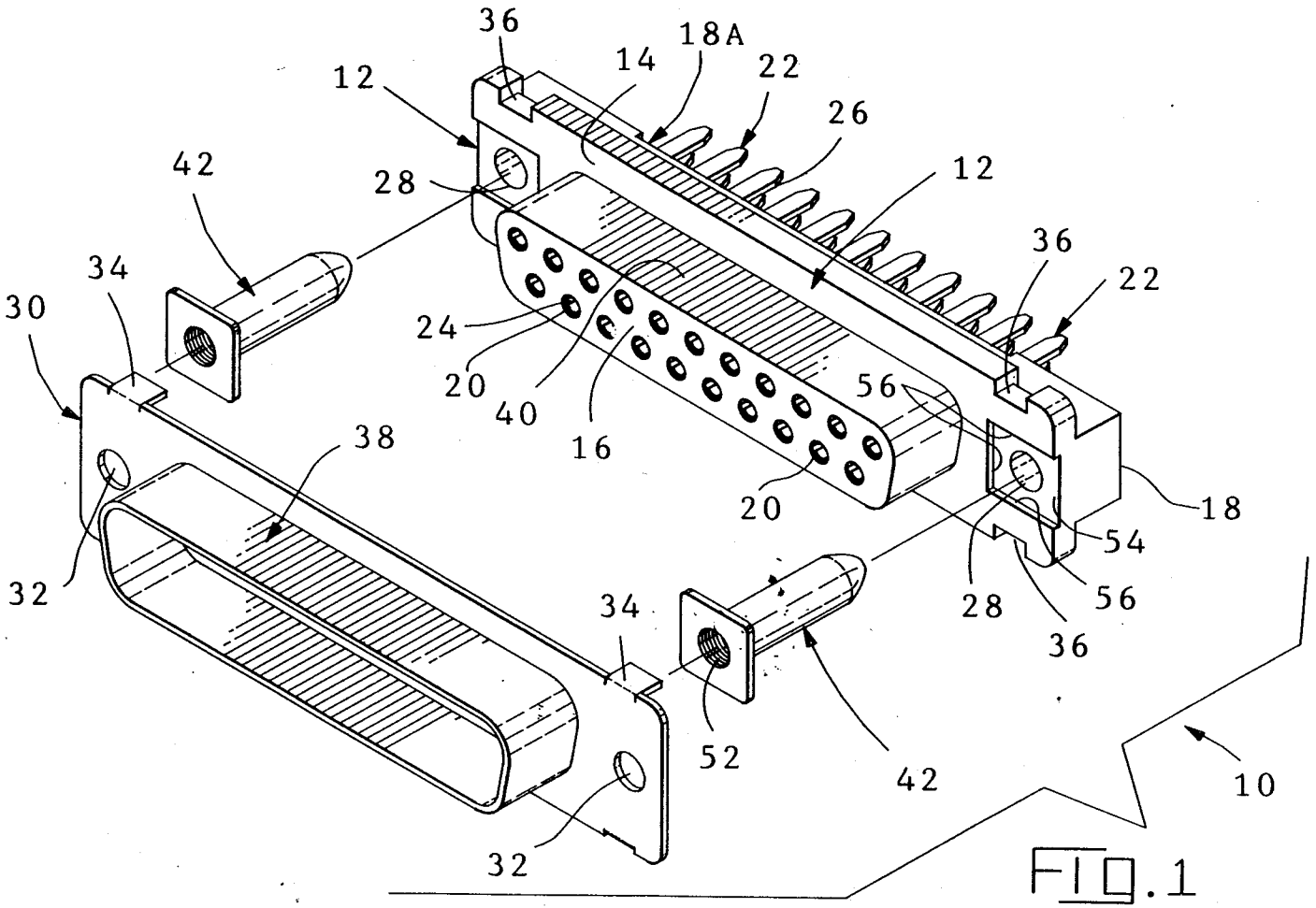
FIG. 1 is an exploded perspective view of a connector assembly in accordance with the present invention.

FIG. 1 is an exploded perspective view of an electrical connector assembly 10 in accordance with the present invention. Connector assembly 10 comprises housing 12 molded of thermoplastic with integral peripheral flange 14, mating face 16 and opposed rear face 8 which serves as a mounting face. A plurality of contact receiving passages 20 extend between mating face 6 and rear face 18 and have contacts 22 received therein. Contacts 22 have a mating portion 24 extending into a contact receiving passage 20 that may be either pins or sockets with mounting portions 26, typically a solder post, that extends from rear face 18. Rear face 18 may be recessed through the area of contact receiving passages 20, as shown at **18*a*, for removal of flux subsequent to soldering. Although housing 12 and contacts 22 are depicted as straight posted, they could be right angle connectors, as are known in the art. Mating face 16 is surrounded by flange 14 having mounting apertures 28** at opposite ends thereof for securing a complementary connector thereto.

Electrically conductive shell 30 has a similar outer profile to flange 14 with shell mounting apertures 32 aligned with apertures 28 in flange 14. Lugs 34 on shell 30 fold into recesses 36 in flange 14 to secure shell 30 to housing 12. Shroud 38 extends upward from the flat portion of shell 30 and conforms to and encloses raised, D-shaped portion 40 of housing 12.

Insert 42 has a tubular shank 44 the outside diameter of which fits in mounting apertures 28 with close tolerance to maintain the axis of insert 42 coaxial with the axis of mounting aperture 28 when insert 42 is received in aperture 28. Housing 12 is manufactured with mounting apertures 28 precisely positioned perpendicular to rear face 18.

Figure 2:
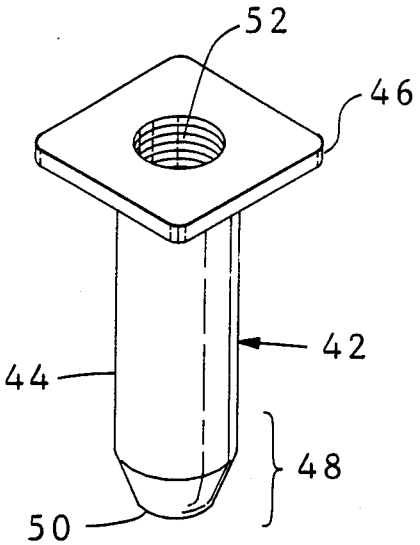
FIG. 2 is a perspective view of a drawn insert.
Figure 6:
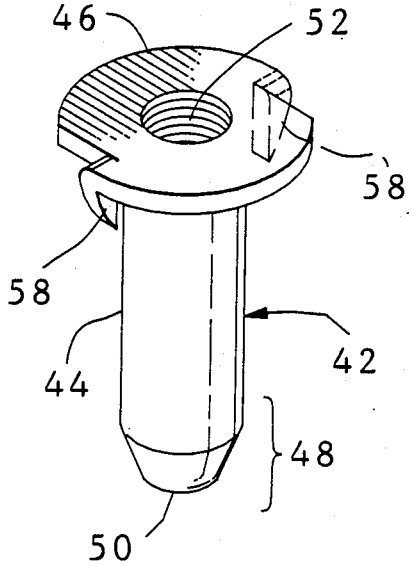
FIG. 6 is a perspective view of the insert of FIG. 2 with an alternate embodiment flange means.

As best seen in FIGS. 2 and 6, insert 42 is deep drawn from a blank, which in the preferred embodiment is brass, to form hollow tubular shank 44 extending from flange means 46 to a closed end 48. Closed end 48 is generally conical, tapering from shank 44 to a tip 50 remote therefrom. Threads 52 are formed in the internal surface of tubular shank 44 to receive complementary threaded securing means 68 through shell mounting apertures 32.

Housing 12 and insert 42 cooperate to form means to prevent insert 42 from rotating in assembly 10. To prevent insert 42 from rotating as a complementary securing means, such as a bolt, is threaded thereinto, a recess 54 defined by recess walls 56 is formed in flange 14 peripheral to apertures 28 to receive flange means 46. During manufacture of connector assembly 10, flange means 46 seats in recess 54 and is maintained there by shell 30. Any attempt to rotate insert 42 causes flange means 46 to engage one or more of recess walls 56 which in turn prevents rotation of insert 42. In a preferred embodiment, both flange means 46 and recess 54 are rectangular in shape as shown in FIGS. 1 and 2.

In an alternate embodiment shown in FIG. 6, flange means 46 has barbs 58 partially sheared therefrom then formed to engage housing 12 to prevent insert 42 from rotating.

The thickness of flange means 46 is greater than the depth of recess 54 in flange 14 of housing 12. This assures that when lugs 34 secure shell 30 to housing 12 there is engagement and hence electrical continuity between shell 30 and insert 42. Continuity is further enhanced when connector assembly 10 is mounted by complementary securing means 68.

Figure 7:
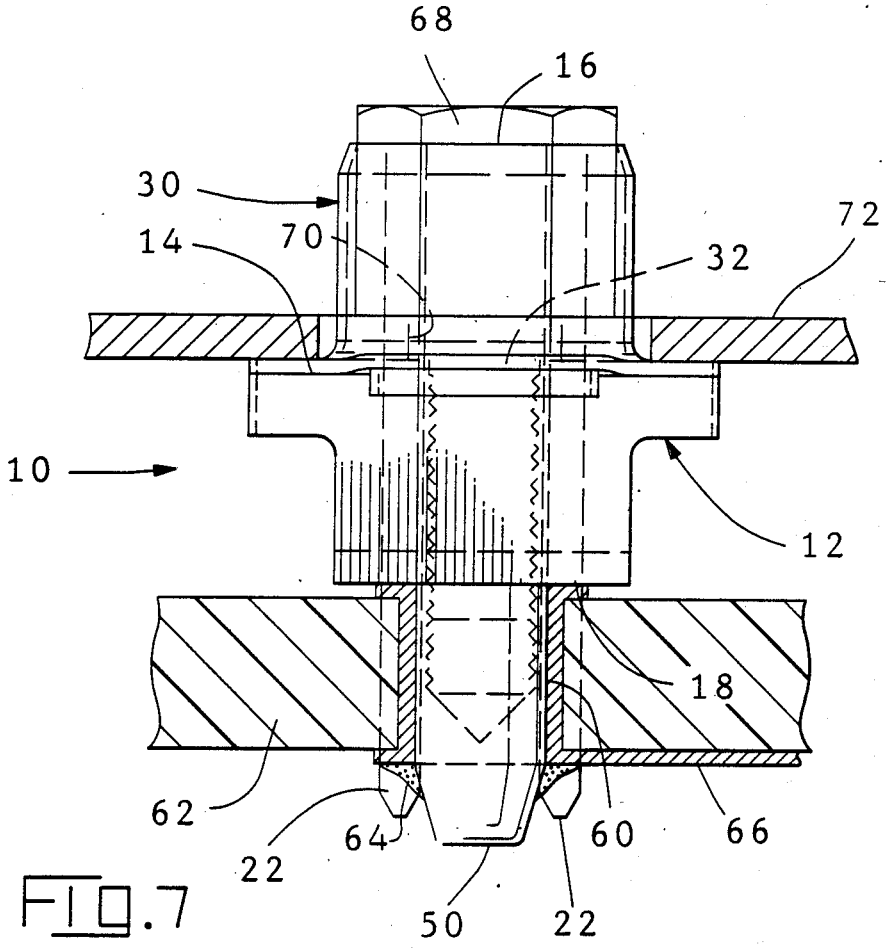
FIG. 7 is an end view, partly in section, of a connector assembly in accordance with the present invention soldered on a printed circuit board and mounted through a panel.

As shown in FIG. 7, insert 42 extends beyond housing 12. Shank 44 is typically received in an aperture 60 in a printed circuit board 62 with the tapered end 48 facilitating insertion into aperture 60. Solder 64 secures insert 42 to printed circuit board 62 and completes a ground path from shell 30 through insert 42 and solder 64 to trace 66 on printed circuit board 62. Since insert 42 is soldered it is typically tin plated during manufacturing. The closed tip 50 of insert 42 prevents solder from wicking into the interior of shank 44; such wicking of solder would interfere with threads 52.

Figure 3A:
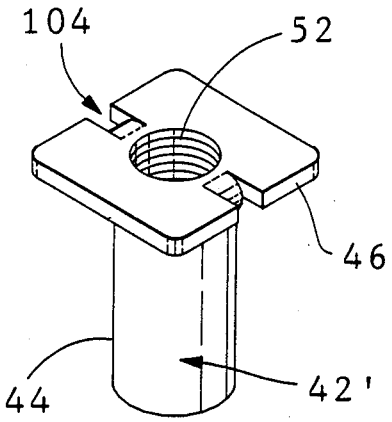
FIG. 3 is a perspective view of an alternate embodiment insert.
Figure 3B:
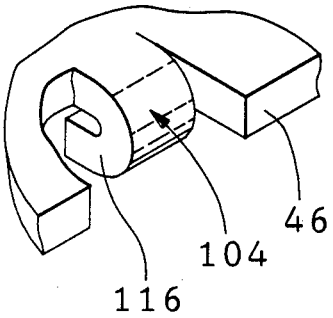

An alternate embodiment insert 42' is shown in FIG. 3 wherein shank 44 terminates in an open end. Typically, the shank in this embodiment of insert 42' would be shorter than the shank of insert 42.

Figure 4:
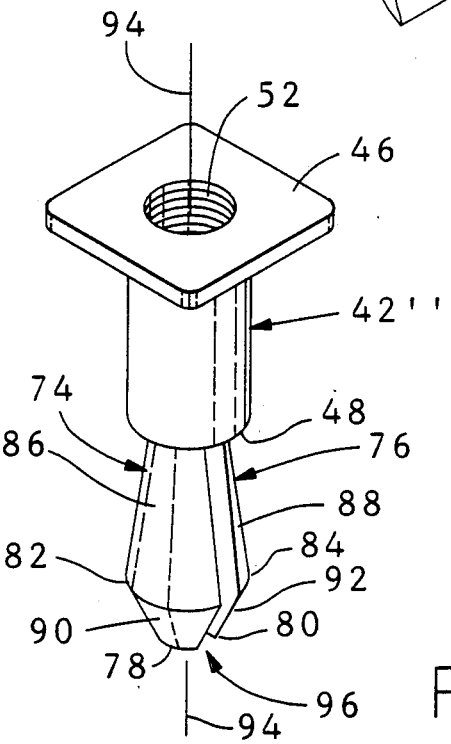
FIG. 4 is a perspective view of yet another alternate embodiment insert.

An alternate embodiment insert 42'' disclosed in FIG. 4 has spring means 74,76 integral with and extending from closed end 48 to respective free ends 78,80. Each of spring means 74,76 has an arris 82,84 located intermediate closed end 48 and respective free ends 78,80. Each of spring means 74,76 has a diverging section 86,88 between closed end 48 and respective arrises 82,84, and a converging section 90,92 between arrises 82,84 and free ends 78,80. Diverging sections 86,88 and converging sections 90,92 provide surfaces that diverge and converge, respectively, with respect to the axis 94 of insert 42'' in the direction from closed end 48 to free ends 78,80.

The alternate embodiment insert 42'' shown in FIG. 4 is made by machining insert 42'' to form spring members 74,76. This portion of insert 42'' may initially be a solid cylinder. Machining removes a portion of the cylinders to shape diverging and converging sections 86, 88, 90, 92. Subsequently the material previously in space 96 is removed, thus resulting in spring means 74,76.

Figure 8:
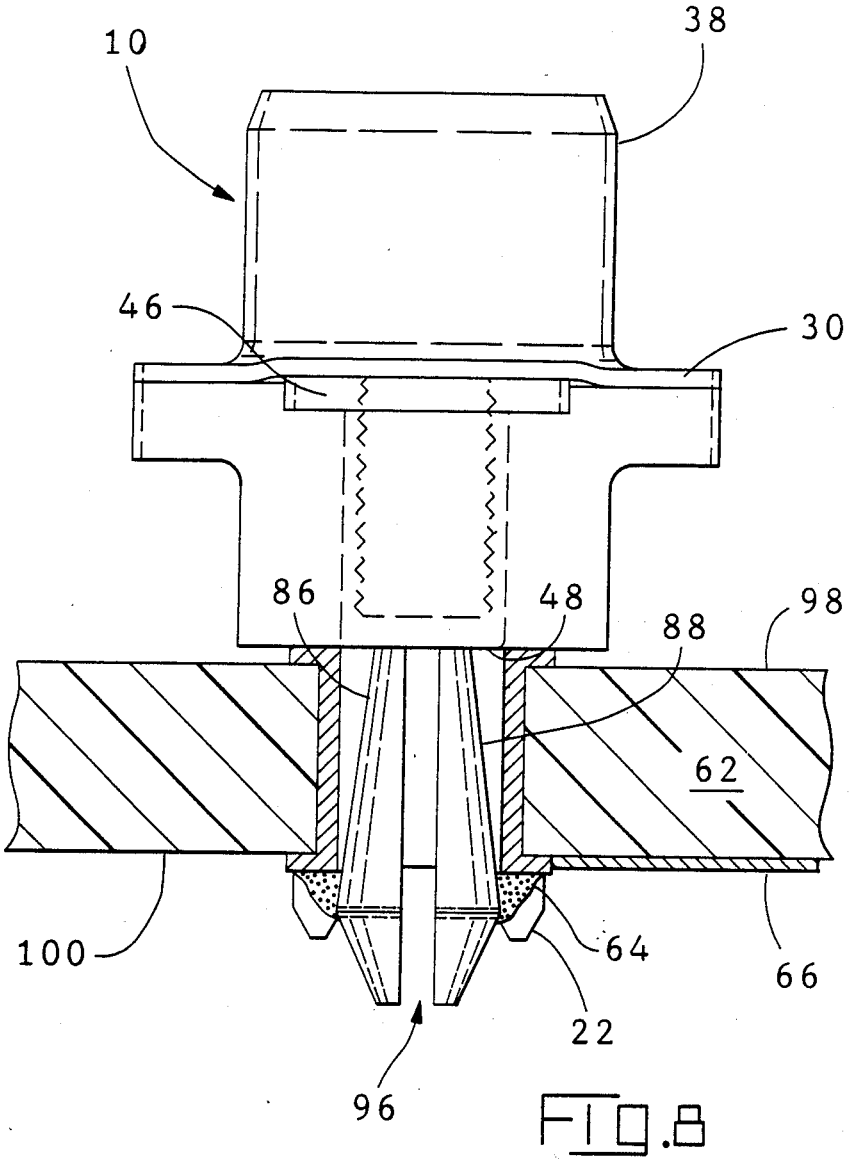
FIG. 8 is an end view, partially in section, of a connector assembly incorporating the insert of FIG. 4 soldered on a printed circuit board.

The insert 42'' of FIG. 4 may be an element of a connector assembly 10 employed to secure the connector assembly 10 to a printed circuit board, as best seen in FIG. 8. With insert 42'' secured in recess 54 as described above, insert 42'' is axially aligned with insert receiving aperture 60. Connector assembly 10 is moved toward printed circuit board 62 until housing 12 substantially engages the printed circuit board. Converging sections 90,92 engage the periphery of aperture 60 at upper surface 98 and provide a tapered lead-in as free ends 78,80 are received in aperture 60. As converging sections 90,92 move past upper surface 98, the axial force causing the relative motion causes a reaction between converging sections 90,92 and upper surface 98 which, in turn, causes spring means 74,76 to deflect inward toward axis 94, decreasing space 96. As arrises 82,84 exit from aperture 60, lower surface 100 rides up diverging sections 86,88, as spring means 74, 76 relax, moving away from axis 94 toward their unbiased position. Diverging sections 86,88 thus substantially engage the periphery of aperture 60 at lower surface 100. In accordance with known practice, aperture 60 may have a plated through hole received therein and which diverging sections 86,88 would engage.

When the components on printed circuit board 62 are soldered, solder may complete a circuit to trace 66 and is drawn into space 96. It may be desirable or undesirable to permit solder to fill space 96, and bridge over. The size of space 96 may be adjusted to accomplish the desired result.

Figure 5:
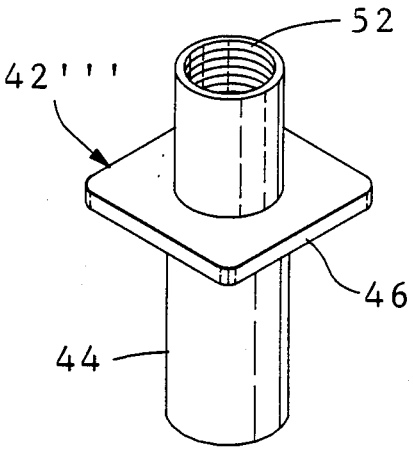
FIG. 5 is a perspective view of yet another alternate embodiment insert.

Yet another alternate embodiment insert is shown in FIG. 5. This alternate embodiment insert 42''' is shown in connector assembly 10 mated to a complementary connector 112 in FIG. 9. In this alternate embodiment, insert 42''' has a spacer means 102 extending from flange means 46. Spacer means 102 has a hollow bore with threads 52 extending therethrough from shank 44. Spacer means 102 is typically cylindrical to conveniently pass through apertures 32 in shell 30. Spacer means 102 need not be the same outside diameter as shank 44.

Figure 9:
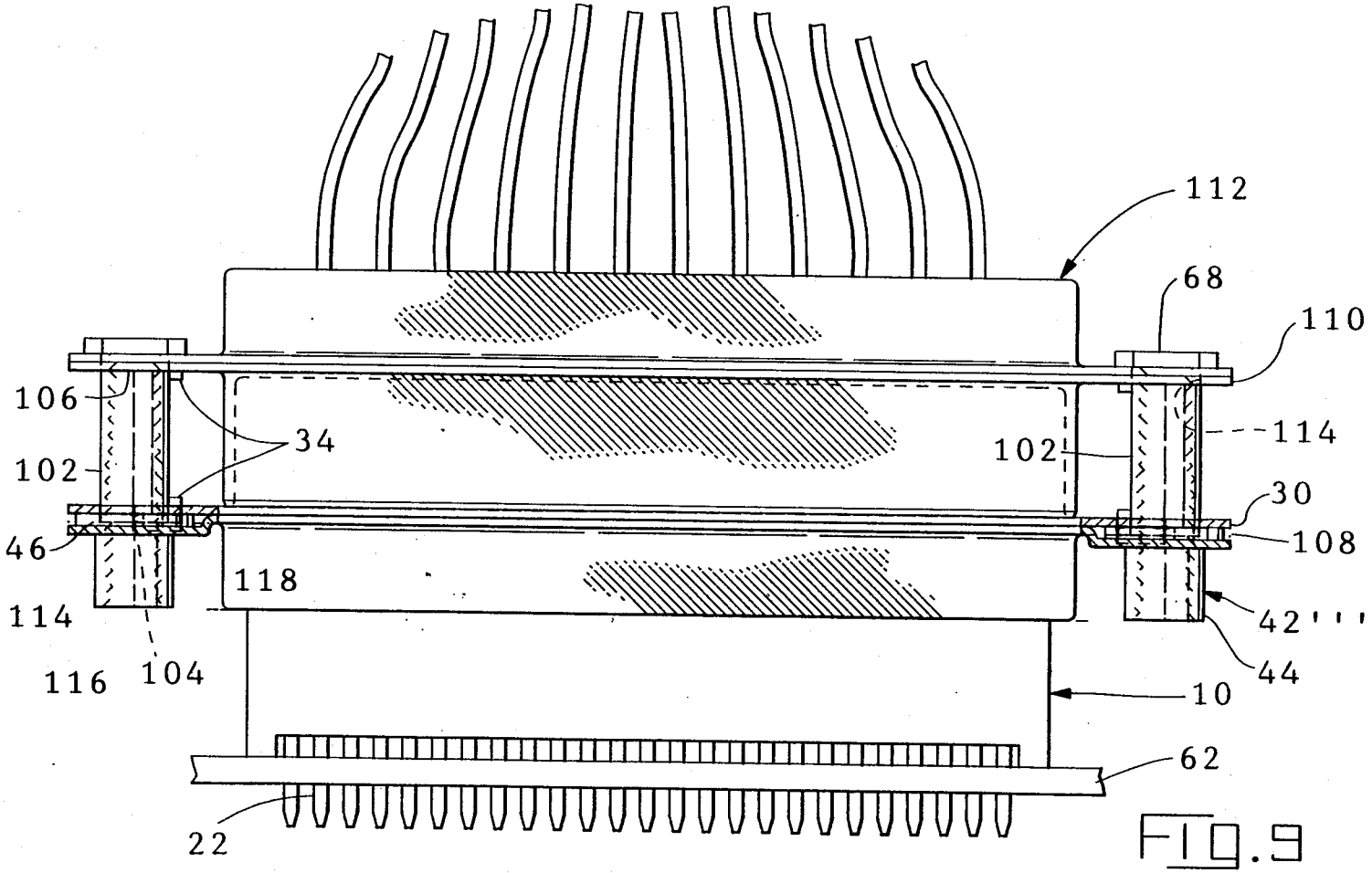
FIG. 9 is an side view, partially in section, of a connector assembly securing the insert of FIG. 5 between two shell members, and mated to a complementary connector.

As shown in FIG. 9, a recess 54 having walls 56 may be defined in a rear shell member 108 to receive flange 46 of any of the alternate embodiments of the insert. Housing 12 is secured as part of assembly 10 by shell member 30,108. The insert is secured in recess 54 engaging shell 30 or shell member 108 in the manner described above. The insert is thus electrically conductive with shell 30 or shell member 108.

The length of spacer means 102 is selected such that when insert 42''' is mounted in aperture 28 and shell 30 is secured thereover with spacer means 102 extending through apertures 32, surface 106 of spacer means 102 is a predetermined distance from shell 30 to provide a surface to engage the shell 110 of a complementary mated connector 112, as best seen in FIG. 9. Spacer means 102 thus prevents shells 30 and 110 from being drawn together due to being secured together and concomitantly electrically commons shells 110 and 30 of the mated connectors which may be board mounted.

As best seen in FIG. 7, complementary securing means 68 passes through an aperture 70 in panel 72 to engage threads 52 and secure connector assembly 10 soldered to printed circuit board 62 to panel 72. Concomitantly, flange means 46 is drawn toward panel 72 with shell 30 sandwiched therebetween ensuring engagement and electrical continuity between surface panel 72 and shell 30.

As best seen in FIG. 9, complementary securing means 68 passes through aperture 114 in shell 110 to threadingly engage threads 52 in screwlock 42''' thereby securing complementary mated connector 112 to connector assembly 10.

Flange 46 in any of the alternate embodiment inserts may include tabs 104 formed by shearing a portion of flange 46 and forming tab 104 over resulting in a greater thickness and further antirotation shoulders 116. A further cavity 118 is formed in recess 54 or the insert receiving aperture in flange 30 or flange member 108 to accommodate tabs 104. Shoulders 116 are adapted to be received in cavity 118 to provide additional resistance to the insert rotating when a threaded securing means is threaded into threads 52.

A connector assembly 10 has been disclosed in which an insert having a flange and threads 52 internal to shank 44 is received in an aperture 28 in either a connector shell or housing and provides the between a shell portion of the assembly 10 and a trace 66 on a printed circuit board 62 on which the assembly is mounted. The end 48 of the insert 42 is tapered to facilitate insertion into an aperture 60 in the printed circuit board 62. The closed tip 50 prevents solder from wicking into the interior of shank 44.

We claim:

1. An electrical connector assembly, comprising:

a dielectric housing defining a mating face and a mounting face, said housing having a plurality of terminal receiving passages extending from the mating face, and an integral flange having an aperture therethrough;

a drawn insert extending through the aperture in the housing flange and beyond the housing, said insert having a hollow shaft and a closed end, said insert having integral flange means engaging said housing flange for preventing rotation of said insert, said insert having internal threads in said hollow shaft for receiving a complementary securing means; and an electrically conductive shell, said shell having means for securing the shell to said housing, said shell having a shroud portion disposed proximate the mating face to engage shielding of a complementary shielded connector, said shell electrically conductive with the drawn insert, said shell having an aperture aligned with said shaft of said insert.

2. An electrical connector assembly as recited in claim 1 wherein the shaft of the insert proximate the closed end is tapered.

3. An electrical connector assembly as recited in claim 1 further comprising electrical contacts received in the terminal receiving passages.

4. An electrical connector assembly as recited in claim 1 wherein the means for securing the shell to the housing comprises tabs integral with the shell that fold over the housing.

5. An electrical connector assembly as recited in claim 1 wherein the housing further comprises a recess in the flange of the dielectric housing proximate the aperture to receive the insert flange means, said recess defining recess walls extending into the housing flange, said insert flange means adapted to be received in said recess and to engage a recess wall upon attempted rotation of the insert, whereby when a complementary securing means is threaded into the insert, rotation of the insert relative to the housing is prevented.

6. An electrical connector assembly as recited in claim 5 wherein the thickness of the insert flange means is greater than the depth of the recess in the flange of the dielectric housing, whereby electrical continuity is assured between the insert and the shell.

7. An electrical connector assembly as recited in claim 5 wherein the recess and flange means are rectangular in shape.

8. An electrical connector assembly as recited in claim 1 wherein said closed end further comprises a pair of spring means extending therefrom to respective free ends, at least one of said spring means having an arris located intermediate the closed end and said free ends, said at least one spring means having a diverging section intermediate said closed end and said arris, and a converging section intermediate said arris and the free end of said at least one spring means, said diverging section diverging from a longitudinal axis of said insert in the direction from said closed end toward said free ends, said converging section converging toward the longitudinal axis of said insert in the direction from said closed end toward said free ends.

9. An electrical connector assembly as recited in claim 8 wherein each of the pair of spring means has a diverging section and a converging section.

10. An electrical connector assembly as recited in claim 8 wherein the length of the diverging section along the axis of the insert is at least as great as the thickness of the printed circuit board on which the connector assembly is adapted to be mounted, whereby when the connector is mounted to a printed circuit board by passing the free ends of the spring means into an insert receiving aperture therein from a first side of the printed circuit board until the housing engages the first side, a second side of the printed circuit board peripheral to the insert receiving aperture engages the diverging section of the insert thereby securing the electrical connector assembly to the printed circuit board.

11. An electrical connector assembly as recited in claim 8 wherein said diverging section and said converging section are contiguous defining said arris.

12. An electrical connector assembly, comprising:

a dielectric housing defining a mating face and a mounting face, said housing having a plurality of terminal receiving passages extending from the mating face, and an integral flange having an aperture therethrough;

an insert extending into the aperture in the housing flange, said insert having a hollow shaft, said insert having integral flange means engaging said housing flange for preventing rotation of said insert, said insert having internal threads in said hollow shaft for receiving a complementary securing means; and an electrically conductive shell, said shell having means for securing the shell to said housing, said shell having a shroud portion disposed proximate the mating face to engage shielding of a complementary shielded connector, said shell electrically conductive with the drawn insert, said shell having an aperture aligned with said shaft of said insert.

13. An electrical connector assembly as recited in claim 12 further comprising electrical contacts received in the terminal receiving passages.

14. An electrical connector assembly as recited in claim 12 wherein the means for securing the shell to the housing comprises tabs integral with the shell that fold over the housing.

15. An electrical connector assembly as recited in claim 12 wherein the housing further comprises a recess in the flange of the dielectric housing proximate the aperture to receive the insert flange means, said recess defining recess walls extending into the housing flange, said insert flange means adapted to be received in said recess and to engage a recess wall upon attempted rotation of the insert, whereby when a complementary securing means is threaded into the insert, rotation of the insert relative to the housing is prevented.

16. An electrical connector assembly as recited in claim 15 wherein the thickness of the insert flange means is greater than the depth of the recess in the flange of the dielectric housing, whereby electrical continuity is assured between the insert and the shell.

17. An electrical connector assembly as recited in claim 15 wherein the recess and flange means are rectangular in shape.

18. An electrical connector as recited in claim 12 further comprising a spacer means integral with said insert and extending from said integral flange in a direction opposite said shaft a predetermined distance, said spacer means defining a surface at the end thereof adapted to engage a mated connector, said spacer means having a threaded bore for receiving the complementary securing means.

19. An electrical connector assembly comprising:

a dielectric housing defining a mating face and a mounting face, said housing having a plurality of terminal receiving passages extending from the mating face;

flange means having an aperture therethrough;

an insert extending into the aperture in the flange means, said insert having a hollow shaft, said insert having integral flange means engaging said flange means for preventing rotation of said insert, said insert having internal threads in said hollow shaft for receiving a complementary securing means; and an electrically conductive shell, said shell having means for securing the shell to said flange means, said shell having a shroud portion disposed proximate the mating face to engage shielding of a complementary shielded connector, said shell electrically conductive with the insert, said shell having an aperture aligned with said shaft of said insert.

20. An electrical connector assembly as recited in claim 19 wherein the flange means further comprises a recess in the flange means proximate the aperture to receive the insert flange means, said recess defining recess walls extending into the flange means, said insert flange means adapted to be received in said recess and to engage a recess wall upon attempted rotation of the insert, whereby when a complementary securing means is threaded into the insert, rotation of the insert relative to the housing is prevented.

21. An electrical connector assembly as recited in claim 20 wherein the thickness of the insert flange means is greater than the depth of the recess in the flange means, whereby electrical continuity is assured between the insert and the shell.

22. An electrical connector assembly as recited in claim 19 wherein said insert further comprises an integral spacer means extending from said integral flange means in a direction opposite said shaft a predetermined distance, said spacer means defining a surface at the end thereof adapted to engage a mated connector, said spacer means having a threaded bore for receiving the complementary securing means.

23. An electrical connector assembly as recited in claim 19 wherein said insert further comprises a closed end.

24. An electrical connector assembly as recited in claim 23 wherein said closed end further comprises a pair of spring means extending therefrom to respective free ends, at least one of said spring means having an arris located intermediate the closed end and said free ends, said at least one spring means having a diverging section intermediate said closed end and said arris, and a converging section intermediate said arris and the free end of said at least one spring means, said diverging section extending transverse to and diverging from a longitudinal axis of said insert in the direction from said closed end toward said free ends, said converging section extending transverse to and converging toward the longitudinal axis of said insert in the direction from said closed end toward said free ends.

25. An electrical connector assembly as recited in claim 20 further comprising tab means formed on the insert flange means and a cavity in the flange means to receive said tab means.

* * * * *